US006283206B1

(12) United States Patent
Fraser et al.

(10) Patent No.: US 6,283,206 B1
(45) Date of Patent: Sep. 4, 2001

(54) GAS LIFT UMBILICAL CABLE AND TERMINATION ASSEMBLIES THEREFOR

(75) Inventors: Dana John Fraser; Alva W. Davis, both of Panama City, FL (US)

(73) Assignee: Kellogg, Brown & Root, Inc., Houston, TX (US)

( * ) Notice: Subject to any disclaimer, the term of this patent is extended or adjusted under 35 U.S.C. 154(b) by 0 days.

(21) Appl. No.: 09/347,586

(22) Filed: Jul. 1, 1999

(51) Int. Cl.[7] ..... E21B 17/00; F16L 11/00; F16L 11/20; F16L 11/22

(52) U.S. Cl. ..... 166/242.3; 138/138; 285/222.1

(58) Field of Search ..... 166/242.2, 242.3; 138/118, 118.1, 124, 127, 131, 133, 134, 138; 285/222.1, 222.2, 222.3, 222.5

(56) References Cited

U.S. PATENT DOCUMENTS

| | | | | |
|---|---|---|---|---|
| 2,298,738 | * | 10/1942 | Kimmich et al. | 285/222.5 X |
| 3,877,520 | * | 4/1975 | Putnam | 166/366 |
| 4,234,019 | * | 11/1980 | Hornor et al. | 285/222.2 X |
| 4,377,186 | * | 3/1983 | Genini et al. | 138/133 X |
| 4,423,283 | * | 12/1983 | Weismann | 138/131 X |
| 4,726,314 | * | 2/1988 | Ayers | 114/243 |
| 5,183,966 | * | 2/1993 | Hurtado et al. | 174/20 |
| 5,269,349 | * | 12/1993 | Sugier et al. | 138/133 X |
| 5,506,818 | * | 4/1996 | Johnston | 367/144 |
| 6,012,495 | * | 1/2000 | Antonsen | 138/131 |

OTHER PUBLICATIONS

MCS International, Document No. 214029/RP01, "Schematic of Typical Flexible Riser Cross Sections," May 28, 1997.

American Petroleum Institute, API Specification 17E, Second Edition, Sep. 1, 1998 "Specification for Subsea Production Control Umbilicals" Appendix E, pp 43 and 44.

American Petroleum Institute, API Recommended Practice 17B, Second Edition, Jul. 1, 1998 "Recommended Practice for Flexible Pipe", pp15 and 17.

* cited by examiner

*Primary Examiner*—David Bagnell
*Assistant Examiner*—Tara L. Mayo
(74) *Attorney, Agent, or Firm*—Haynes & Boone, L.L.P.

(57) ABSTRACT

A gas lift umbilical including a flexible pipe having a collapse resistant wall and a first sealing layer formed on an interior surface of the collapse resistant wall. The interior surface defines a longitudinal passage. A flexible gas lift hose is mounted within the longitudinal passage extending from a first end of the flexible pipe to a second end thereof. A first fitting is attached to the collapse resistant wall of the flexible pipe at a first end thereof. A second fitting is attached to the collapse resistant wall of the flexible pipe at a second end thereof. A first adapter joins a first end of the gas lift hose to the first fitting and a second adapter joins a second end of the gas lift hose to the second fitting.

19 Claims, 6 Drawing Sheets

GAS LIFT UMBILICAL CABLE AND TERMINATION ASSEMBLIES THEREFOR

BACKGROUND

The disclosures herein relate generally to collapse resistant umbilical structures and more particularly to gas lift umbilical and end termination assemblies.

Oil from oil bearing reservoirs is sometimes produced by the inherent reservoir pressure. In many cases, however, the reservoir lacks sufficient inherent pressure to force the oil from the reservoir upwardly to a wellhead structure where the oil is transported from the wellhead structure by flowlines. When the pressure of a production zone of a reservoir is not sufficient to force the oil products to the wellhead under the inherent pressure of the reservoir, a number of methods may be used to artificially produce pressure to force the oil products to the wellhead.

One common method is known as gas lift whereby gas is injected through a gas lift hose under controlled pressure into the annulus between the production tubing and the well casing. The gas mixes with and aerates the fluids in the production tubing thereby providing a lifting force for lifting the fluids to the surface. The gas that is injected is commonly referred to as an export gas. Methanol may also be injected to reduce the amount of wax accumulated in the production lines.

In deep water subsea oil field operations, umbilicals, hoses, risers and the like generally must be resistant to collapse due to hydrostatic pressure. The collapse pressure is the external hydrostatic pressure required to cause the umbilical structure to buckle. The hydrostatic pressure is proportional to the depth of the seawater such that the hydrostatic pressure increases with increasing seawater depths. For example, at a water depth of 340 meters, the hydrostatic pressure is approximately 500 psi.

Gas lift hoses are commonly used in subsea oil production operations. A typical gas lift hose includes a core, an inner sheath, a kevlar-aramid armor layer and an outer sheath. However, commercially/available gas lift hoses generally do not have sufficient compressive hoop strength to resist hydrostatic collapse. These types of hoses are typically constantly pressurized to prevent the hose from collapsing. In the event that pressure is lost, the hose will collapse due to the hydrostatic pressure. It is common for the collapse to result in permanent damage to the hose. A common alternative design for gas lift hose elements is to add a carcass internal to the hose. This carcass is typically some type of steel to resist the hydrostatic pressure. This requires different production processes and equipment than is normally used.

Accordingly, a need has arisen for an apparatus that is configured to overcome the shortcomings of prior art and, in particular, a core of a gas lift umbilical cable that utilizes collapsible gas lift hoses within a non-collapsible flexible pipe.

SUMMARY

One embodiment, accordingly, provides a umbilical having at least one collapsible hose carried within a non-collapsible flexible pipe. To this end, one embodiment provides an umbilical including a flexible pipe having a collapse resistant wall and a first sealing layer formed on an interior surface of the collapse resistant wall. The interior surface defines a longitudinal passage. A plurality of flexible conveyance elements are mounted within the longitudinal passage extending from a first end of the flexible pipe to a second end thereof. At least a portion of the conveyance elements have a collapsible wall.

A key advantage of an umbilical according to the present embodiments is that the conveyance elements can be constructed of conveyance elements such standard hydraulic hoses having collapsible wall constructions. These types of standard hoses are less expensive than specialized hoses.

BRIEF DESCRIPTION OF THE DRAWING FIGURES

DETAILED DESCRIPTION

Figure 1:
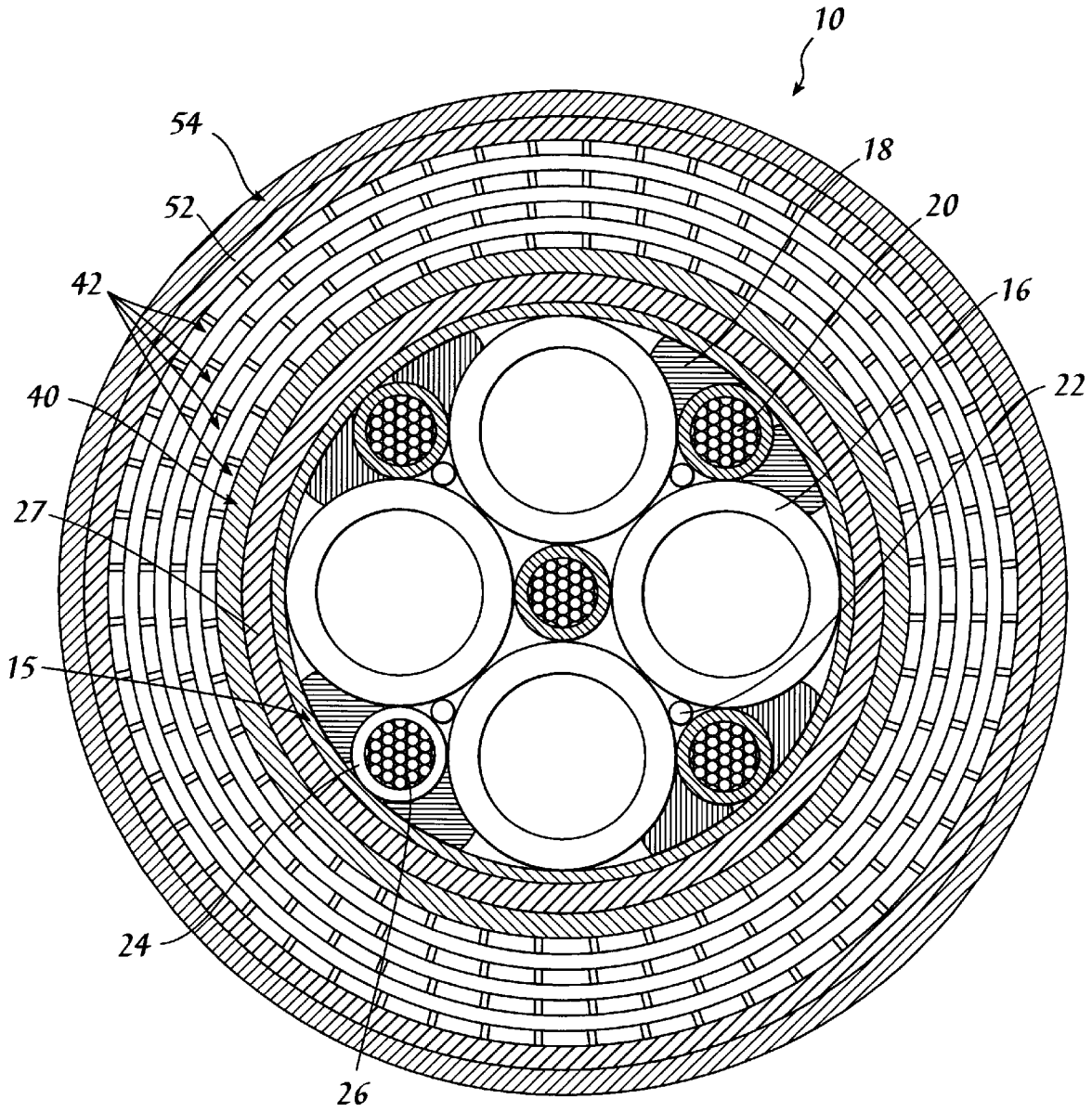
FIG. 1 is a cross sectional view illustrating an embodiment of a gas lift umbilical.
Figure 2:
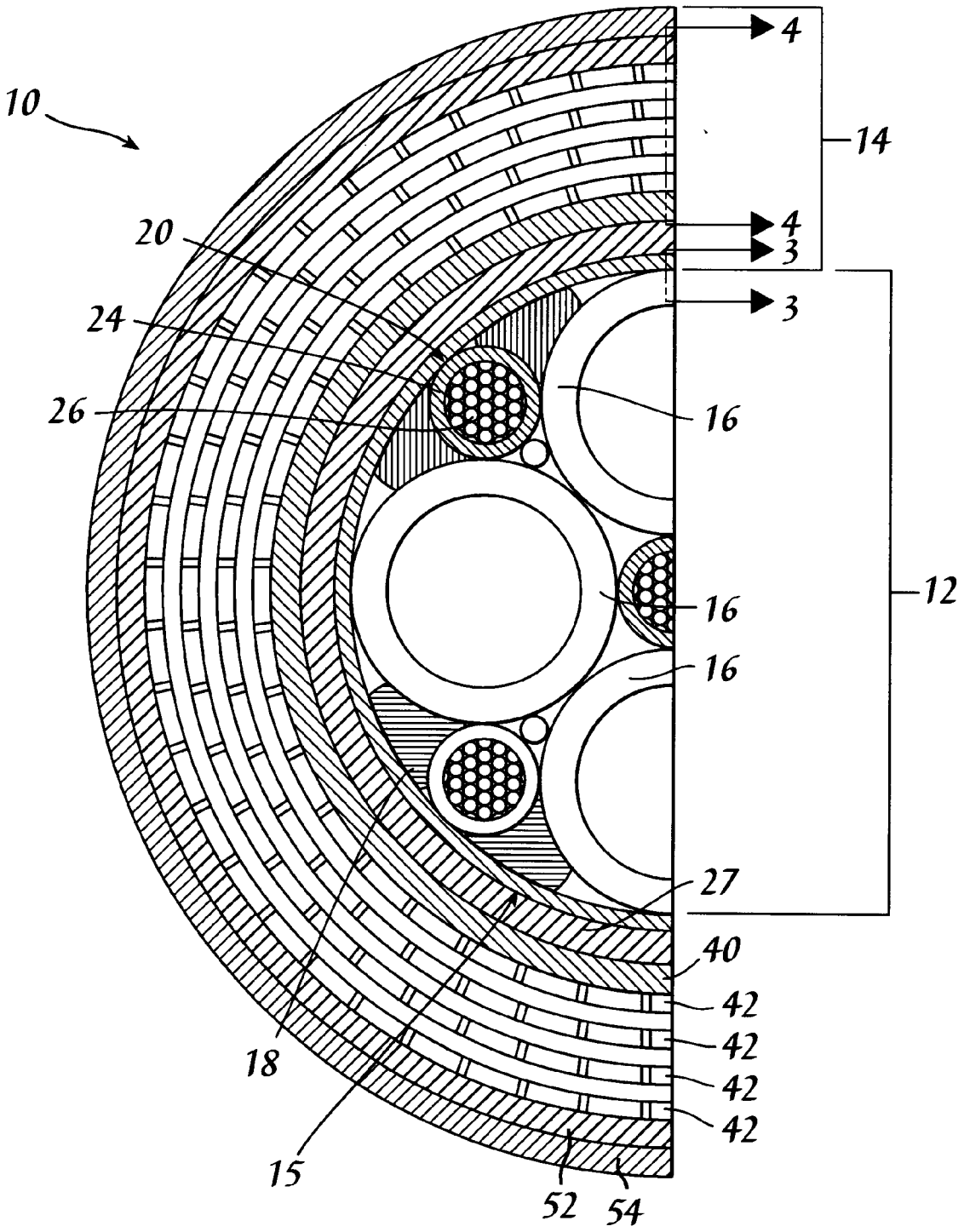
FIG. 2 is a fragmented cross-sectional view illustrating an embodiment of a gas lift umbilical.

FIGS. 1 and 2 illustrate an embodiment of a gas lift umbilical 10, hereinafter referred to as a GLU. The GLU 10 includes a core 12 surrounded by a flexible pipe 14. The flexible pipe 14 isolates the core L2 from hydrostatic pressure. The core 12 includes a protective sheath 15 formed to encase the gas lift hoses 16, stranded fillers 18, wire rope fillers 20, and air hoses 22.

Flexible conveyance elements such as gas lift hoses 16 are utilized to inject export gas into a well to provide gas lift assistance to a related production riser. Methanol may also be injected to reduce the amount of waxes that may accumulate in the production riser. Each gas lift hose 16 is a standard hydraulic hose having a collapsible wall such as a FURON SYNFLEX 33GL-20000 1¼" gas lift hose. FURON SYNFLEX 33GL-20000 is a gas lift hose rated to 3000 psi with a NYLON 11 inner sheath, an aramid braid armor layer, and a polyurethane outer sheath.

A grease is applied to the gas lift hoses 16 during manufacturing of the core 12. The grease prevents adhesion of the gas lift hoses 16 to adjacent components of the core 12, allowing the gas lift hoses 16 to move freely relative to the adjacent components. The grease is preferably a silicone grease such as DOW CORNING 4 silicone grease.

Each wire rope filler 20 consists of a sheath 24 extruded over a plurality of helically wound steel strands 26. The sheath may be formed of nylon or any other suitable material. One wire rope filler 20 may have a sheath 24 of a different color than the others to provide a key to determine hose identification from each end. The key selection requirements for material used for the wire rope filler 20 are weight, abrasion resistance, bending stiffness and fatigue resistance.

The stranded fillers 18 are added as a manufacturing aid. The stranded fillers fill the void between each gas lift hose 16 and the protective sheath 15. The stranded filler 18 may be manufactured by slitting a single ribbon of material such as a polypropylene. It is preferred that the stranded filler 18 be stranded rather than solid such that it can effectively conform to and shape around the gas lift hoses 16 and wire rope fillers 20.

The air hoses 22 enable the moisture content at the subsea end of the umbilical to be monitored. The air hoses 22 may be formed of nylon or other suitable material. The air hoses 22 are small enough to fit into the voids between two gas lift hoses 16 and an adjacent wire rope filler 20.

As best shown in FIGS. 1 and 2, the flexible pipe 14 includes an armor layer 27 that is consists of a circumferentially wound strip of material such as steel or other suitable material. The armor layer 27 is wound directly over the abrasion resistant layer of the core 12. The armor layer 27 resists internal and external pressure in the hoop direction. The strips of material forming the armor layer 27 interlock but do not preclude the GLU 10 from being flexed.

Figure 3:
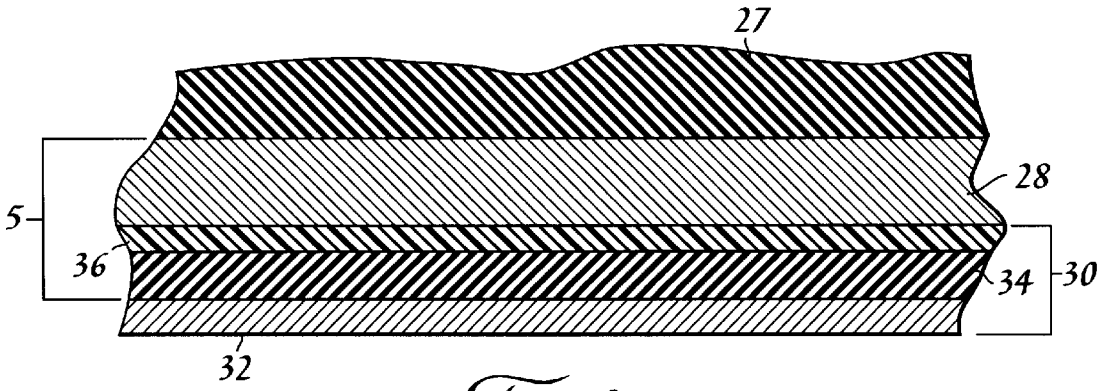
FIG. 3 is a fragmentary cross-sectional view illustrating an embodiment of the protective sheath of the gas lift umbilical.

As shown in FIG. 3, the protective sheath 15 includes an extruded core abrasion resistant layer 28 formed over a barrier layer 30. The core abrasion resistant layer 28 protects the underlying tape layers from abrasion. The core abrasion resistant layer 28 also adds structural stiffness to the core 12.

The barrier layer 30 includes three tape layers. The first barrier tape layer 32 is formed over the contents of the core 12 to protect the contents from heat during extrusion of the core abrasion resistant layer 28. The first barrier tape layer may be a corrugated tape of extruded polyester. A second barrier tape layer 34 is formed over the first barrier tape layer 32. The second barrier tape layer may be a high tensile filament tape consisting of a polyester backing reinforced with continuous polyester yarn filament and bonded to a pressure activated adhesive. A third barrier tape layer 36 is applied over the second tape layer 34 to minimize outgassing from the second barrier tape layer 34 and to provide a smooth surface over which the abrasion resistant layer 28 can be extruded.

As best shown in FIGS. 1 and 2, the flexible pipe 14 includes the armor layer 27 that consists of a circumferentially wound strip of material such as steel or other suitable material. The armor layer 27 is wound directly over the abrasion resistant layer of the core 12. The armor layer 27 resists internal and external pressures by virtue of its strength in the hoop direction. Adjacent windings of the strips interlock but do not preclude the GLU 10 from being flexed.

Figure 4:
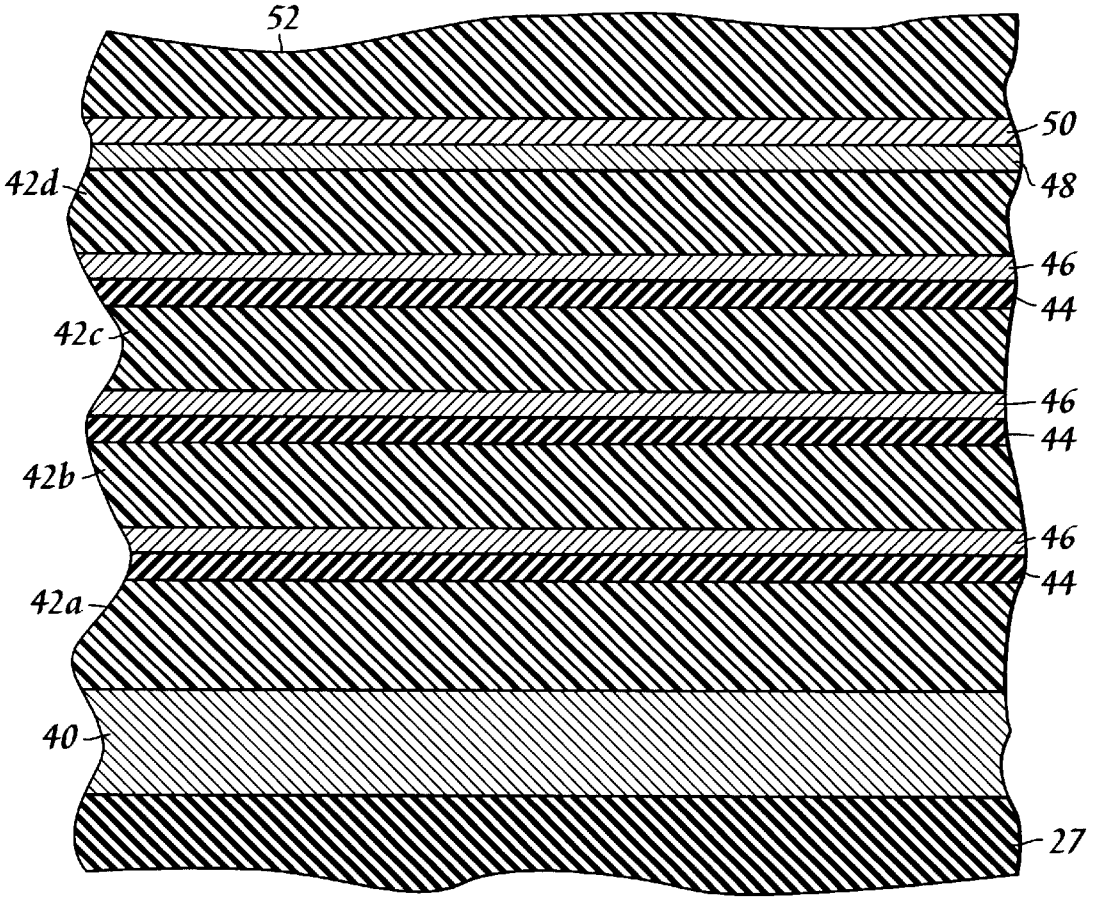
FIG. 4 is a fragmentary cross-sectional view illustrating an embodiment of the various layers in the flexible pipe of a gas lift umbilical.

As best shown in FIG. 4, an interior sealing layer 40 is formed over the armor layer 27. The interior sealing layer 40 may be extruded of a material such as nylon. The interior sealing layer 40 provides an interior seal to protect against leakage due to the hydrostatic pressure.

Four tensile layers 42 are formed over the interior sealing layer 40 to provide for axial strength. Each tensile layer 42 consists of carbon steel wires formed into helixes and installed in contra wound pairs of layers. Each tensile layer 42 is preformed. The tensile layers 42 are wound over the underlying layer of material and secured with a series of tape layers.

Each of the three innermost tensile layers 42*a*–42*c* has a first tensile tape layer 44 formed over them followed by a second tensile tape layer 46. The first and second tensile tape layers 44, 46 are substantially the same as the first and second barrier tape layers 32, 34, respectively, of the barrier layer 30. The first and second tensile tape layers 44, 46 aid in keeping the three innermost tensile layers 42*a*–42*a* in position prior to an exterior sealing layer 52 being extruded over them. The first and second tensile layers 44, 46 also minimize intrusion of the exterior sealing layer 52 into the gaps of the tensile layers 42 during extrusion.

The outermost (fourth) tensile tape layer 42*d* has a third tensile tape layer 48 formed over it followed by a fourth tensile tape layer 50. The third tensile tape layer 48 may be a polyester tape and the fourth tensile tape layer 50 may be a fabric tape. The fourth tensile tape layer 50 provides a smooth surface for extruding the exterior sealing layer 52 onto, and minimizes the outgassing of, the first tensile tape layer 44.

The exterior sealing layer 52 is a polymer barrier applied to resist mechanical damage. The exterior sealing layer 52 also aids in precluding the intrusion of seawater into the GLU 10. The exterior sealing layer 52 may be formed of nylon. An exterior abrasion resistant layer 54, illustrated in FIGS. 1 and 2, may be formed over the exterior sealing layer 52.

ATOCHEM RILSAN P40/TL/OS/PA11 nylon polymer is a preferred material for the various extruded GLU layers. This material offers exceptional abrasion resistance. It has been used successfully world-wide for several years as the material for the flexible extruded layers of umbilicals.

Referring now to FIGS. 5–8, the GLU 10 is terminated with topside and subsea termination assemblies 100, 102. The topside termination assembly 100 includes a topside GLU end fitting 104 and a topside shroud 108. Similarly, the subsea termination assembly 102 includes a subsea end fitting 106 and a subsea shroud 110. The shrouds 108, 110 are welded to the respective end fittings 104, 106.

Figure 5:
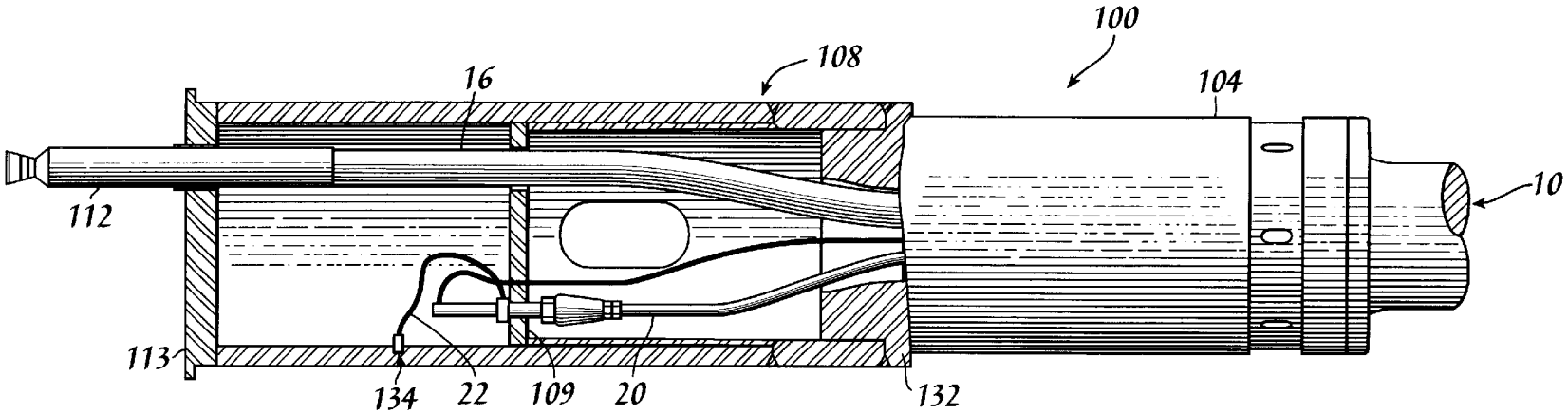
FIG. 5 is a partial side view illustrating an embodiment of a topside termination assembly.
Figure 6:
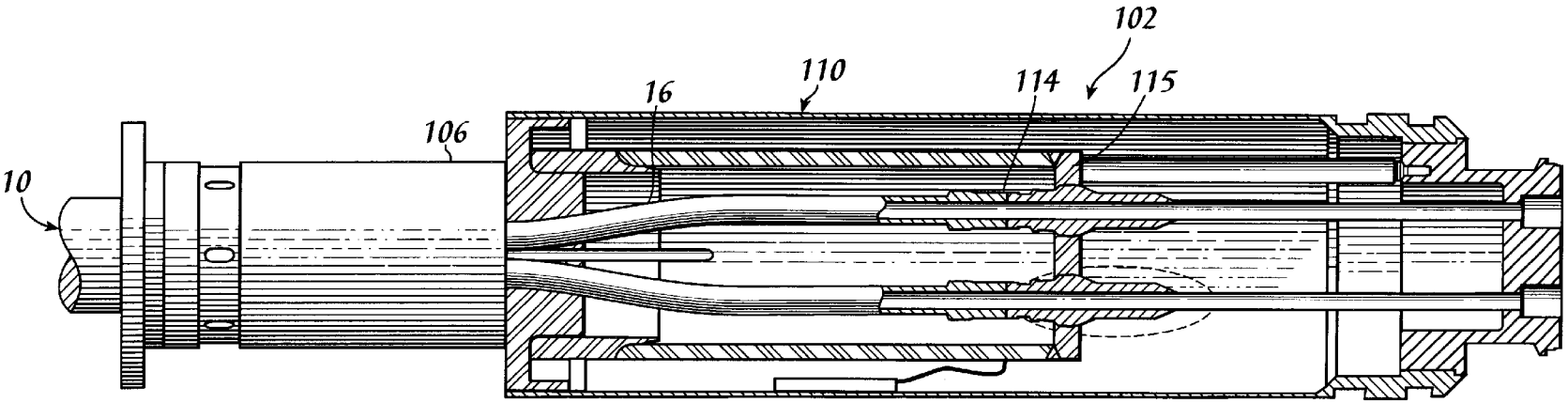
FIG. 6 is a partial side view illustrating an embodiment of a subsea termination assembly.

As best illustrated in FIGS. 1, 5 and 6 the stranded filler 18 terminates at each GLU end fitting 104, 106 with the gas lift hoses 16 and the air hoses 22 continuing through each GLU end fitting 104, 106 into the respective shroud 108, 110. The gas lift hoses 16 are terminated by topside and subsea hose fittings 112, 114 such as a crimp-type hose coupling. The hose fittings 112 in the topside end termination assembly 100 are welded to an end plate 113 and the hose fittings 114 of the subsea end termination assembly 102 are welded to a subplate 115. The end plate 113 and subplate 115 are welded to the shrouds 108, 110 of the respective end termination assemblies 100, 102.

Figure 7:
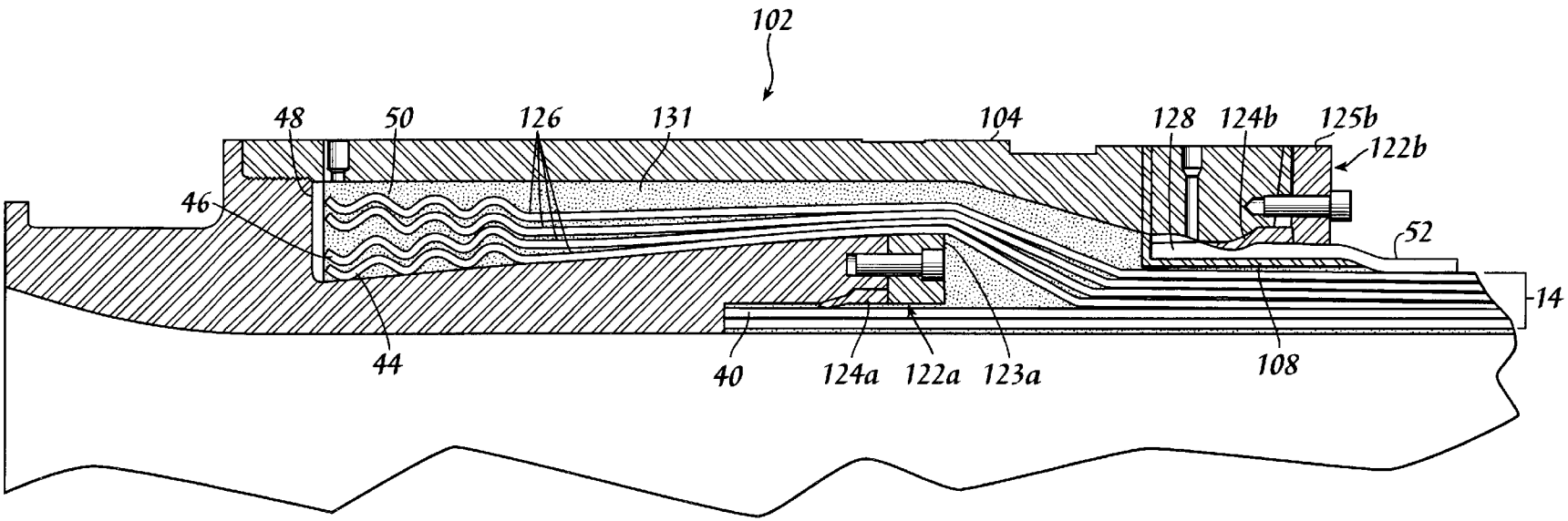
FIG. 7 is a fragmentary side view illustrating an embodiment of the flexible pipe terminating components of a topside termination assembly.

The GLU end fittings 104, 106, FIGS. 5–8 are designed to terminate the ends of each layer of the flexible pipe 14 and to maintain the integrity of the flexible pipe 14 at each end. Each layer of the flexible pipe 14 is individually terminated to maintain fluid tight integrity and to sustain the imposed loads,. The GLU end fittings 104, 106 include interior and exterior flex pipe sealing clamps 122*a*, 122*b*, respectively, to ensure a reliable fluid tight seal to the interior and exterior sealing layers 40, 52, respectively, as illustrated in FIG. 7.

Prior to assembly, the GLU end fittings 104, 106 and related components are degreased using acetone or an equivalent. The fluid-tight interior sealing layer 40 is cut perpendicular to the longitudinal axis of flexible pipe 14. The armor layer 27 is similarly cut at a measured distance behind the initial cut.

Figure 8:
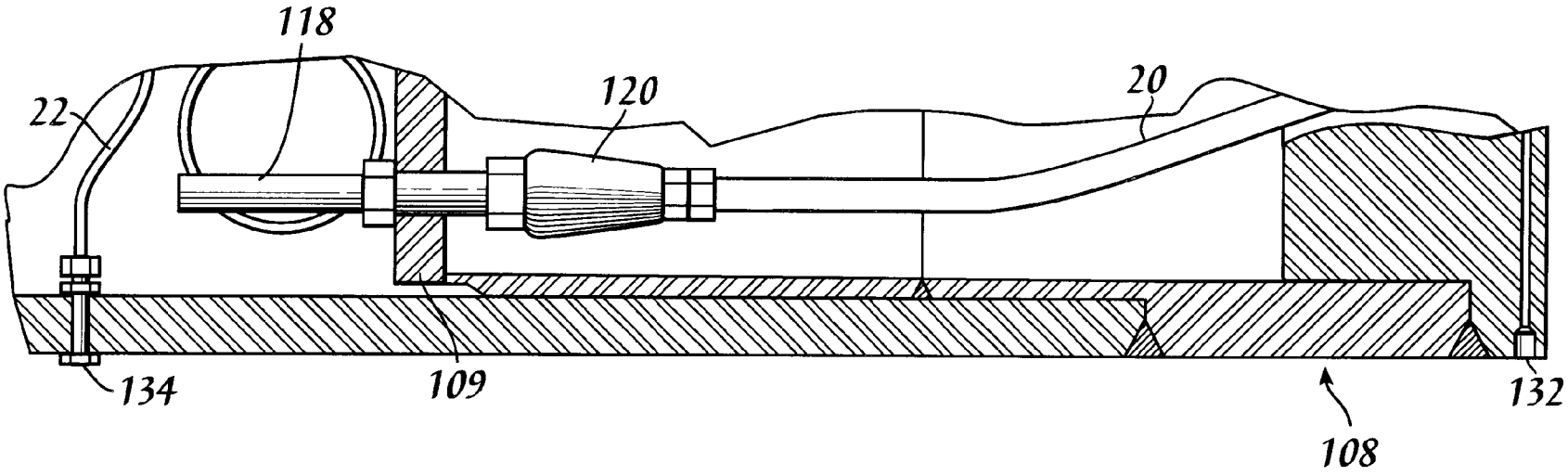
FIG. 8 is a fragmentary side view illustrating an embodiment of the clamping device for securing the wire rope fillers.

At the topside termination assembly 100, as best illustrated in FIG. 8, the wire rope fillers 20 are terminated into a hold-down assembly that includes a stud 118 and a socket 120. Each wire rope filler is received in a respective socket 120 and secured to the subplate 109 by tightening the stud 118. The wire rope fillers 20 are typically attached to a topside bracket and are capable of supporting the weight of the GLU 10 as well as applied loadings.

The interior sealing clamp 122*a* includes a metal seal ring 124*a* having serrated surfaces that are mechanically swaged into the interior sealing layer 40 by an inner collar 125*a*. The seal ring 124 provides a reliable, mechanical fluid-tight seal against fluid leakage from the flexible pipe 14 to the core 12 at either end fitting 104, 106. Fastening the interior collar 125*a* compresses the interior sealing layer between the shroud and the armor layer 27 to provide a reliable mechanical seal against leakage of sea water into the subsea termination assembly 102.

The end terminations 100, 102, FIGS. 5–7 are filled with a potting compound 131. A commercially-available, two-part polyester material or other suitable material may be used. The potting compound 131 serves to anchor the armor layer 27 of FIG. 1. The ends of the tensile layers 42 of FIG. 2 are bent into a geometry such as a sinusoidal configuration and secured with clamp-down members 126 such as steel straps. The tensile layers 42 may be abraded to improve the interface with the potting compound 131.

Similar to the interior sealing clamp 122*a*, the exterior sealing clamp 122*b* includes a metal seal ring 124*b* having serrated surfaces that are mechanically swaged into the exterior sealing layer 52 by an exterior collar 125*b*. The seal ring 124 provides a reliable, mechanical fluid tight seal against fluid leakage from inside the exterior sealing layer 52 into either of the end termination assemblies. Fastening the exterior collar 125*b* compresses the exterior sealing layer between the shroud and the outer sleeve 128 to provide a reliable mechanical seal against leakage of sea water into the subsea termination assembly 102.

To facilitate a venting system, the topside end fitting shroud 108, FIG. 8 may include one or more vent ports 132 for venting the core 12 of the GLU 10, FIGS. 1 and 2 via an exhaust system. In the event of a gas lift hose 16 bursting, the export gas would enter the annulus of the core 12, temporarily pressurizing the core 12. Although the venting system may not have sufficient capacity to immediately vent all of the export gas, gradual venting of the released export gas will be achieved to minimize further damage.

The air hoses 22, FIG. 8, may terminate at the subsea termination assembly 102 as well as at intermediate locations between the topside and subsea termination assemblies. One or more of the air hoses 22 may be used to monitor the moisture content inside the core 12 at the subsea end, see also FIG. 2. One method is to block the vent ports 132 and connect the air hoses 22 at the topside to a monitoring device for monitoring water and methanol content. Each air hose 22 is connected to a hose port 134 in the topside end termination assembly 100. Pressurizing the air hoses 22 with a dry gas, while leaving the vent ports 132 hooked up would assist in drying the core 12. Monitoring the pressure or flow rate curve will allow an indirect measurement of the pressure in the subsea termination assembly 102.

In operation, the embodiments disclosed herein provide a GLU for injecting a gas under controlled pressure into the annulus between the production tubing and the well casing. The GLU includes a plurality of collapsible gas lift hoses carried within a non-collapsible flexible pipe. The flexible pipe resists collapsing due to hydrostatic pressure. The GLU is terminated at each end by a respective end termination assembly. The end termination assemblies are designed to terminate the ends of each layer of the flexible pipe and to maintain the integrity of the flexible pipe at each end. Each layer of the flexible pipe is individually terminated to maintain fluid tight integrity and to sustain the imposed loads.

As a result, one embodiment provides an umbilical including a flexible pipe having a collapse resistant wall and a first sealing layer formed on an interior surface of the collapse resistant wall. The interior surface defines a longitudinal passage. A plurality of flexible conveyance elements are mounted within the longitudinal passage extending from a first end of the flexible pipe to a second end thereof. At least a portion of the conveyance elements exhibit limited resistance to being collapsed by a hydrostatic pressure.

Another embodiment provides a gas lift umbilical including a flexible pipe having a collapse resistant wall and a first sealing layer formed on an interior surface of the collapse resistant wall. The interior surface defines a longitudinal passage. A flexible gas lift hose is mounted within the longitudinal passage extending from a first end of the flexible pipe to a second end thereof. A first end fitting is attached to the collapse resistant wall of the flexible pipe at a first end thereof. A second end fitting is attached to the collapse resistant wall of the flexible pipe at a second end thereof. A first adapter joins a first end of the gas lift hose to the first end fitting and a second adapter joins a second end of the gas lift hose to the second end fitting.

Yet another embodiment provides an end termination assembly for an umbilical including an end fitting attachable to a collapse resistant wall of the umbilical. A shroud is attached at a first end to the end fitting. An adapter is attached at a first end to the shroud.

As it can be seen, a gas lift umbilical according to the present embodiments provides several advantages and benefits. The gas lift lines can be constructed of standard hydraulic hoses. These types of standard hoses are less expensive than specialized gas lift hoses and enable the use of standard hose fittings. The flexible pipe construction provides high hydrostatic pressure collapse resistance. The inner gas lift annulus will be sealed from seawater such that the inner components of the gas lift umbilical are protected against corrosion and hydrostatic pressure.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. An umbilical comprising:

a flexible pipe including a collapse-resistant wall, a longitudinal passage, an interior sealing layer and an exterior sealing layer;

a core within the flexible pipe, the core including a protective sheath encasing a plurality of flexible conveyance elements, a plurality of shape-conforming first fillers, a plurality of second fillers and a plurality of air hoses, the plurality of flexible conveyance elements positioned within the longitudinal passage extending from a first end of the flexible pipe to a second end thereof, at least a portion of the conveyance elements being collapse-resistant to hydrostatic pressure;

a first end fitting and a second end fitting attached to opposite ends of the umbilical;

each end fitting being attached to a respective shroud; and the conveyance elements extending through each end fitting and into the respective shroud;

each end fitting including:

an interior sealing clamp having a first sealing ring clamped onto the interior sealing layer by an inner collar; and an exterior sealing clamp having a second sealing ring clamped onto the exterior sealing layer by an exterior collar.

2. The umbilical of claim 1 wherein at least a portion of the flexible conveyance elements are hydraulic hoses.

3. The umbilical of claim 1 further comprising at least one of said first fillers adjacent each of the conveyance elements.

4. The umbilical of claim 3 wherein the first fillers are conformably engaged between the flexible pipe and the respective conveyance element.

5. The umbilical of claim 1 wherein the second fillers are wire rope fillers within the longitudinal passage extending between the first and second ends of the flexible pipe, the wire rope fillers attached adjacent a first end to a subsea end of the flexible pipe.

6. The umbilical of claim 1 wherein the plurality of air hoses within the longitudinal passage extend from a first end of the flexible pipe towards the second end, at least one of the air hoses being of a different length than each other air hose.

7. The umbilical of claim 1 wherein the collapse-resistant wall of the flexible pipe includes a helically wound layer of metallic strip material.

8. The umbilical of claim 1 wherein the flexible pipe includes a second sealing layer formed adjacent an exterior surface of the collapse resistant wall.

9. The umbilical cable of claim 1 further comprising a first termination assembly attached to a subsea end of the flexible pipe and a second termination assembly attached to a topside end of the flexible pipe.

10. The umbilical of claim 9 wherein the first and second termination assemblies are attached to the collapse-resistant wall.

11. The umbilical of claim 9 wherein the second fillers are wire rope fillers within the longitudinal passage extending between the first and second ends of the flexible pipe, the wire rope fillers attached adjacent a first end to a subsea end of the flexible pipe.

12. The umbilical of claim 9 further comprising a first adapter joining a first end of each conveyance element to a first termination assembly and a second adapter joining a second end of each conveyance element to a second termination assembly.

13. The umbilical of claim 9 wherein the plurality of air hoses within the longitudinal passage extended from a first end of the flexible pipe towards the second end, at least one of the air hoses being of a different length than each other air hose, each air hose being connected to a port formed in the topside termination assembly.

14. The umbilical of claim 9 wherein the collapse-resistant wall includes a tensile bearing layer having a plurality of helically formed wires, the tensile bearing layer being attached to the first termination assembly.

15. The umbilical of claim 1 wherein the collapse resistant wall includes a tensile bearing layer formed from a plurality of wires helically wound along a longitudinal axis of the flexible pipe.

16. The umbilical of claim 1 wherein the flexible conveyance elements are gas lift hoses.

17. An umbilical comprising:

a flexible pipe having a collapse-resistant wall, an interior sealing layer and an exterior sealing layer;

a first end fitting and a second end fitting respectively attached to opposite ends of the umbilical;

a shroud attached at a first end to the end fitting;

a conveyance element;

an adaptor attached at a first end to the conveyance element and at a second end to the shroud; and a sealing clamp including a sealing ring and a collar for securing a sealing layer of the flexible pipe to the shroud, the sealing ring mounted adjacent a layer of the flexible pipe to fixedly retain the sealing layer of the flexible pipe to the shroud in response to engagement of the sealing ring by the collar each end fitting being attached to a respective shroud; and a conveyance element extending through each end fitting and into the respective shroud;

each end fitting including:

an interior sealing clamp having a first sealing ring clamped onto the interior sealing layer by an inner collar; and an exterior sealing clamp having a second sealing ring clamped onto the exterior sealing layer by an exterior collar.

18. The umbilical of claim 17 wherein the first and second sealing rings each include a serrated edge.

19. The umbilical of claim 18 wherein the serrated edges of the first and second sealing rings are swaged into the interior and exterior sealing layers, respectively.

* * * * *